US009355810B2

(12) United States Patent
Chen et al.

(10) Patent No.: US 9,355,810 B2
(45) Date of Patent: May 31, 2016

(54) INTEGRATED FLYING-SPOT X-RAY APPARATUS

(71) Applicant: Nuctech Company Limited, Beijing (CN)

(72) Inventors: Zhiqiang Chen, Beijing (CN); Ziran Zhao, Beijing (CN); Wanlong Wu, Beijing (CN); Xilei Luo, Beijing (CN); Guangwei Ding, Beijing (CN); Yingkang Jin, Beijing (CN); Le Tang, Beijing (CN); Fuhua Ding, Beijing (CN); Bin Sang, Beijing (CN); Shuo Cao, Beijing (CN); Zhimin Zheng, Beijing (CN)

(73) Assignee: Nuctech Company Limited, Beijing (CN)

( * ) Notice: Subject to any disclaimer, the term of this patent is extended or adjusted under 35 U.S.C. 154(b) by 112 days.

(21) Appl. No.: 13/972,478

(22) Filed: Aug. 21, 2013

(65) Prior Publication Data

US 2014/0056412 A1 Feb. 27, 2014

(30) Foreign Application Priority Data

Aug. 21, 2012 (CN) ..... 2012 1 0299797

(51) Int. Cl.
*H01J 35/14* (2006.01)
*G21K 1/04* (2006.01)
(Continued)

(52) U.S. Cl.
CPC ..... *H01J 35/14* (2013.01); *G21K 1/043* (2013.01); *H01J 35/025* (2013.01); *H05G 1/025* (2013.01)

(58) Field of Classification Search
CPC ..... H01J 35/14; H01J 35/025; H01J 37/1474; H05G 1/025; G21K 1/043; A61B 6/06; A61B 6/08; G01N 2223/314; G01N 2223/316
See application file for complete search history.

(56) References Cited

U.S. PATENT DOCUMENTS 2,376,439 A * 5/1945 Machlett et al. ..... 313/246
4,024,401 A * 5/1977 Bernstein et al. ..... 378/181
(Continued)

FOREIGN PATENT DOCUMENTS

CN 101113960 A 1/2008
CN 101183083 A 5/2008
(Continued)

OTHER PUBLICATIONS

Machine Translation of EP0314552A1.*
(Continued)

*Primary Examiner* — Glen Kao
(74) *Attorney, Agent, or Firm* — Kinney & Lange, P.A.

(57) ABSTRACT

Disclosed is an integrated flying-spot X-ray apparatus comprising a ray generator configured to generate the X-ray, a revolving collimator device provided thereon with at least one aperture and arranged to be rotatable about the ray generator, a frameless torque motor configured to drive the revolving collimator device to rotate about the ray generator, and a cooling device configured to cool the ray generator, wherein the ray generator, the revolving collimator device, the frameless torque motor and the cooling device are mounted on an integrated mounting frame. Compared with the prior art, the integrated flying-spot X-ray apparatus according to the present disclosure has a simple and compact structure and is used as a kernel apparatus for fields of safety inspection and medical treatment.

12 Claims, 5 Drawing Sheets

(51) Int. Cl.
*H01J 35/02* (2006.01)
*H05G 1/02* (2006.01)

(56) References Cited

U.S. PATENT DOCUMENTS

| | | | | |
|---|---|---|---|---|
| 2006/0145566 | A1* | 7/2006 | Vogt et al. | 310/254 |
| 2009/0245471 | A1* | 10/2009 | Dahan et al. | 378/141 |
| 2010/0111265 | A1* | 5/2010 | Holm et al. | 378/200 |
| 2011/0274250 | A1* | 11/2011 | Gray et al. | 378/87 |

FOREIGN PATENT DOCUMENTS

| | | | | |
|---|---|---|---|---|
| CN | 202177591 | U | 3/2012 | |
| CN | 102478529 | A | 5/2012 | |
| CN | 202275162 | U | 6/2012 | |
| CN | 102595754 | A | 7/2012 | |
| CN | 202979445 | U | 6/2013 | |
| EP | 0314552 | A1 * | 6/1993 | H01J 36/16 |
| JP | H0475000 | A | 3/1992 | |
| JP | H0557029 | A | 3/1993 | |
| JP | H065382 | A * | 1/1994 | H05G 1/06 |
| WO | 0109594 | A2 | 2/2001 | |
| WO | 2006102274 | A1 | 9/2006 | |

OTHER PUBLICATIONS

Machine Translation of JPH065382A.*

European Search Report dated Jan. 22, 2015, for corresponding European Patent Application No. 13181249.7.

First Chinese Office Action and English translation dated Aug. 13, 2015, for corresponding Chinese Application No. 201210299797.0.

* cited by examiner

INTEGRATED FLYING-SPOT X-RAY APPARATUS

CROSS-REFERENCE TO RELATED APPLICATIONS

This application claims the benefit of Chinese patent application CN 201210299797.0, which was filed on Aug. 21, 2012, and which is incorporated herein in its entirety by reference.

BACKGROUND

The present disclosure pertains to the technical field of X-ray generator, and in particular, relates to an integrated flying-spot X-ray apparatus.

A conventional X-ray apparatus emits an X-ray along a conical plane or a sector plane and cannot dynamically scan an object spot by spot. At present, scanning by means of an integrated flying-spot X-ray apparatus is desired in the field of safety inspection and medical treatment. To this end, there is a need to provide an integrated flying-spot X-ray apparatus which can alleviate or eliminate at least one the foregoing technical problems.

SUMMARY

The present invention has been made bearing in mind of the above technical problems existing in the prior art.

An object of this disclosure is to provide an integrated flying-spot X-ray apparatus so as to meet requirements of the field of safety inspection and medical treatment.

According to one aspect of the present disclosure, there is provided an integrated flying-spot X-ray apparatus comprising a ray generator configured to generate the X-ray; a revolving collimator device provided thereon with at least one aperture and arranged to be rotatable about the ray generator; a frameless torque motor configured to drive the revolving collimator device to rotate about the ray generator; and a cooling device configured to cool the ray generator, wherein the ray generator, the revolving collimator device, the frameless torque motor and the cooling device are mounted on an integrated mounting frame.

With the above structure, the X-ray apparatus emits a sector-shaped X-ray, and the dynamic spot-by-spot scanning operation of the ray can be achieved by rotating the revolving collimator device with an aperture provided outside of the sector-shaped X-ray.

Furthermore, the integrated mounting frame comprises a supporting frame configured to support the frameless torque motor and the cooling device, and a bracket configured to be fixedly connected with the supporting frame to fix the ray generator. With such structure, the supporting frame and the bracket are used to integrate the above-mentioned respective functional devices to form an integrated flying-spot X-ray apparatus with a compact structure.

Specifically, the ray generator comprises an X-ray tube, a high voltage generator configured to drive the X-ray tube, an inner protecting sleeve provided outside of the X-ray tube, and an outer sleeve provided outside of the inner protecting sleeve, wherein the inner protecting sleeve and the outer sleeve each have a ray outlet, and the ray outlets are aligned with each other and communicate with each other to direct the X-ray from the X-ray tube out of the ray generator.

Furthermore, an anode end cap is provided at a side of an anode target of the X-ray tube, and between the anode end cap and the anode target is further provided a first anode insulation protecting seat and a second anode insulation protecting seat which are combined to form a labyrinth channel. A cathode protecting end cap is provided at a side of a cathode of the X-ray tube, and between the cathode protecting end cap and the cathode of the X-ray tube is further provided a labyrinth protecting ring.

In the above embodiments, the respective ray outlets of the inner protecting sleeve and the outer sleeve are provided therein with a calking window, and calking window is made of a material through which the X-ray can pass or penetrate.

More specifically, a cavity around the X-ray tube is filled with high voltage insulation oil, and between the labyrinth protecting ring and the cathode protecting end cap is further provided an expansion drum.

In the above embodiments, the cathode protecting end cap, the inner protecting sleeve, the second anode insulation protecting seat, the first anode insulation protecting seat and the labyrinth protecting ring are made of a material that can shield the X-ray, and the second anode insulation protecting seat and the first anode insulation protecting seat exhibits insulation property.

In an embodiment, the cathode protecting end cap is provided with a bending through hole, and the cathode protecting end cap and the expansion drum are fitted together to form a gas chamber. Thus, when the expansion drum is pressed, the gas therein is discharged through the hole of the cathode protecting end cap.

Specifically, the outer sleeve is provided with a beam exiting opening opened at a certain angle, and the outer sleeve is further formed on the outer side wall thereof with a boss having a shaft shoulder.

More specifically, the first anode insulation protecting seat and the second anode insulation protecting seat are combined integrally to form a cavity, and a fluid guiding hole on the first anode insulation protecting seat and a liquid injecting hole on the second anode insulation protecting seat are misaligned with each other, so that a labyrinth structure is formed. The first anode insulation protecting seat and the second anode insulation protecting seat have a high voltage insulation performance and can prevent leakage of the ray. Thus, the outer cavity of the X-ray tube can be ensued to have high voltage insulation and prevent leakage of the ray.

In an embodiment, the revolving collimator device comprises at least one bearing supported on the boss having the shaft shoulder of the outer sleeve, a flying-spot revolving protecting ring supported by the at least on bearing and configured to be revolvable about the outer sleeve, and side protecting plates provided at two sides of the flying-spot revolving protecting ring, respectively, and right and left end caps. With this structure and construction, the revolving collimator device with the aperture is provided around the outer sleeve of the ray generator, and the collimator device of the revolving collimator device revolves by means of the bearing. Furthermore, the revolving collimator device with the aperture is driven by the frameless torque motor, and the dynamic spot-by-spot scanning of the ray is achieved by revolving about the aperture of the collimator device provided outside of the ray generator.

Specifically, the cooling device comprises a magnetic pump configured to pump the heated high voltage insulation oil, a heat exchanger configured to cool the pumped high voltage insulation oil, and an oil passage configured to convey the pumped high voltage insulation oil into the heat exchanger for heat exchanging, and the cooled high voltage insulation oil returns back into the cavity around the X-ray tube. Since the cavity of the ray generator is filled with the high voltage insulation oil, the circulation system constituted by connecting the above components in series can be used to cool the anode target of the bulb tube so as to ensure the normal operation of the integrated X-ray apparatus.

With the above configuration and construction, at least one of the following advantages can be achieved:

(1) a dynamic spot-by-spot scanning of the ray can be achieved;

(2) a compact structure is obtained; and (3) the material used can efficiently shield the ray.

DETAILED DESCRIPTION

Next, embodiments of the present disclosure are further described in combination with the drawings.

Figure 1:
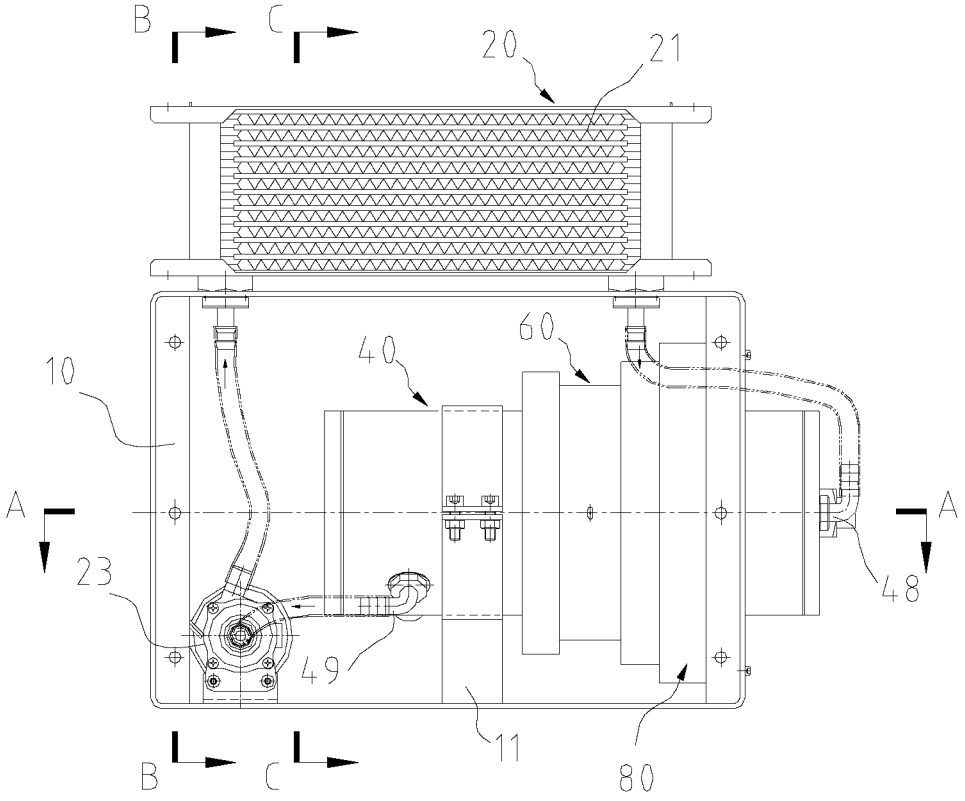
FIG. 1 is a front view of an embodiment of the present disclosure.

With reference to FIG. 1, a general structure of a specific embodiment of the present disclosure is shown. An integrated flying-spot X-ray apparatus according to the present disclosure comprises a ray generator 40 configured to generate an X-ray, a revolving collimator device 60 provided thereon with at least one aperture and arranged to be rotatable about the ray generator 40, a frameless torque motor 80 configured to drive the revolving collimator device 60 to rotate about the ray generator 40, and a cooling device 20 configured to cool the ray generator 40. The ray generator 40, the revolving collimator device 60, the frameless torque motor 80 and the cooling device 20 are integrally mounted on frames 10 and 11. The integrally mounted frames or integrated frames 10, 11 comprise a supporting frame 10 configured to support the frameless torque motor 80 and the cooling device 20, and a bracket 11 configured to be fixedly connected with the supporting frame 10 to fix the ray generator 40. The supporting frame 10 is used for supporting the frameless torque motor 80 and the cooling device 20, and the bracket 11 is used for supporting the ray generator 40.

Figure 2:
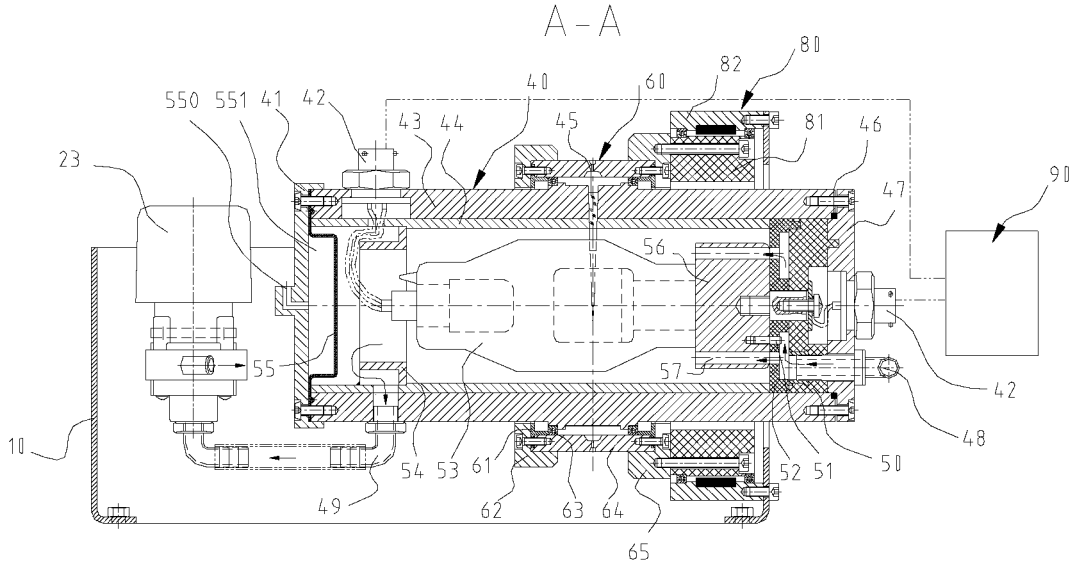
FIG. 2 is a sectional view taken along the A-A line of FIG. 1.

With reference to FIG. 2, the ray generator 40 may comprise a cathode protecting end cap 41, a plug 42, such as an aviation plug, an outer sleeve 43 with a ray outlet, an inner protecting sleeve 44 with a ray outlet, calking windows 45, an 0-shaped sealing ring 46, an anode end cap 47, a high voltage generator 90, a tube joint 49, a second anode insulation protecting seat 50, a positioning pin 51, a first anode insulation protecting seat 52, a bulb tube 53, a labyrinth protecting ring 54, and an expansion drum 55.

As shown in FIG. 2, the ray generator 40 comprises an X-ray tube 53, a high voltage generator 90 configured to drive the X-ray tube 53, an inner protecting sleeve 44 provided outside of the X-ray tube 53 and used for shielding and protecting; and an outer sleeve 43 provided outside of the inner protecting sleeve 44 and used for protecting. The inner protecting sleeve 44 and the outer sleeve 43 each have a ray outlet. The ray outlets are aligned with each other and hence communicate with each other to direct the X-ray from the X-ray tube 53 out of the ray generator 40. As shown in FIGS. 2 and 7, the high voltage generator 90 loads a high voltage onto the two ends of the bulb tube 53 through the aviation plug 42, so that the X-ray is generated. The ray exits from an opening 72 forming a sector-shaped conical beam. The opening 72 is provided on the outer sleeve 43 and is opened with a certain angle, e.g., 110 degrees shown in FIG. 6, along the circumferential direction. As shown in FIG. 2, the positioning pin 51 is used for defining the beam outputting direction of the bulb tube 53.

Figure 8:
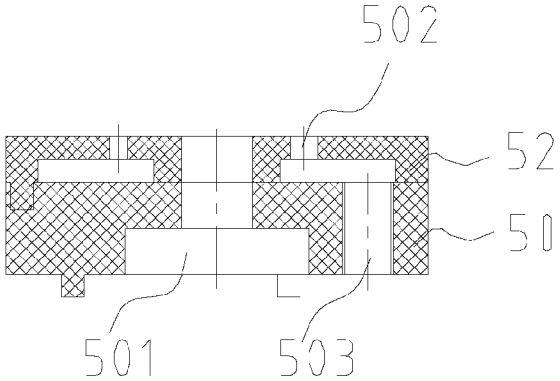
FIG. 8 is a front view in which a first anode insulation protecting seat and a second anode insulation protecting seat are assembled.

Specifically, the anode end cap 47 is provided at an anode target 56 side of the X-ray tube 53. The first anode insulation protecting seat 52 and the second anode insulation protecting seat 50 are further provided between the anode end cap 47 and the anode target 56, and they form a labyrinth channel. The cathode protecting end cap 41 is provided at a cathode side of the X-ray tube 53. The labyrinth protecting ring 54 is further provided between the cathode protecting end cap 41 and the cathode of the X-ray tube 53. As shown in FIG. 8, the first anode insulation protecting seat 52 and the second anode insulation protecting seat 50 are combined integrally to form a cavity 501. A fluid guiding hole 502 on the first anode insulation protecting seat 52 and a liquid injecting hole 503 on the second anode insulation protecting seat 50 are misaligned with each other, so that a labyrinth structure is formed. As shown in FIG. 2, the labyrinth protecting ring 54 functions to form a labyrinth for a cathode lead outlet and high voltage insulation oil returning outlet so as to prevent leakage of the ray.

As shown in FIG. 2, the respective ray outlets of the inner protecting sleeve 44 and the outer sleeve 43 are provided therein with a calking window 45. The material for the calking window 45 is a material through which the X-ray can pass. After passing through the respective ray outlets of the inner protecting sleeve 44 and the outer sleeve 43 and the calking windows 45, the ray exits along the direction perpendicular to the longitudinal axis of the radiation source generator 40 in a predetermined angle range, such as a 4 degree angle range shown in FIG. 5.

As shown in FIG. 2, the cathode protecting end cap 41, the inner protecting sleeve 44, the second anode insulation protecting seat 50, the first anode insulation protecting seat 52 and the labyrinth protecting ring 54 are made of a material that can shield the ray, and the second anode insulation protecting seat 50 and the first anode insulation protecting seat 52 have an insulation property. The cathode protecting end cap 41 is provided with a bending through hole 550. When the cathode protecting end cap 41 and the expansion drum 55 are fitted together, a gas chamber 551 is formed.

Figure 10:
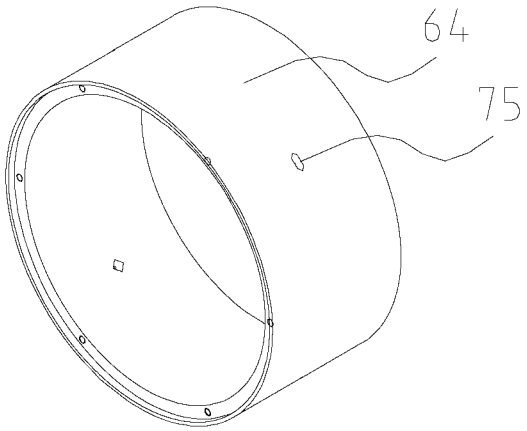
FIG. 10 is a three-dimension view of a flying-spot revolving protecting ring.

With reference to FIG. 7, the outer sleeve 43 is provided with the beam exiting opening 72. The outer sleeve 43 is also formed on the outer side wall thereof with a boss 71 having a shaft shoulder. As shown in FIGS. 2, 7 and 10, the revolving collimator device 60 comprises at least one bearing 63 supported on the boss 71 having the shaft shoulder of the outer sleeve 43, a flying-spot revolving protecting ring 64 supported by the at least on bearing 63 and configured to be revolvable about the outer sleeve 43, side protecting plates 61 provided at two sides of the flying-spot revolving protecting ring 64, respectively, and right and left end caps 62 and 65.

Figure 5:
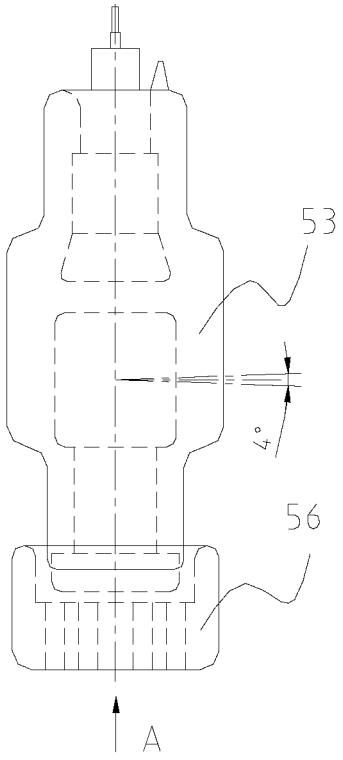
FIG. 5 is a front view of a bulb tube.
Figure 6:
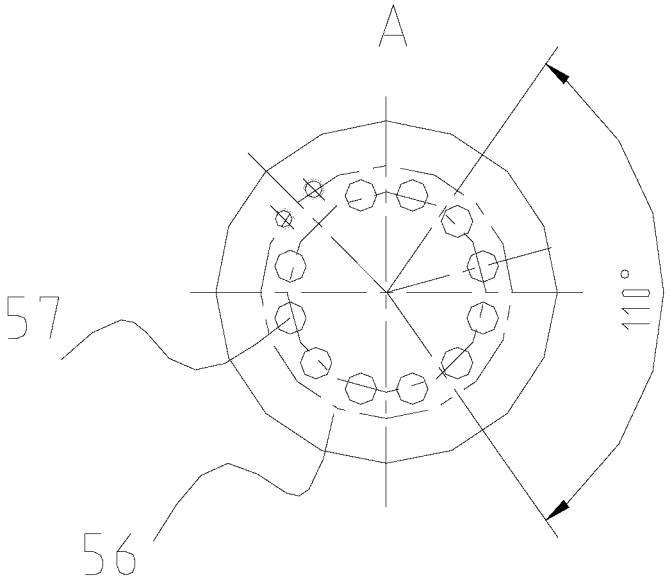
FIG. 6 is a view, along the A direction, of the bulb tube.
Figure 7:
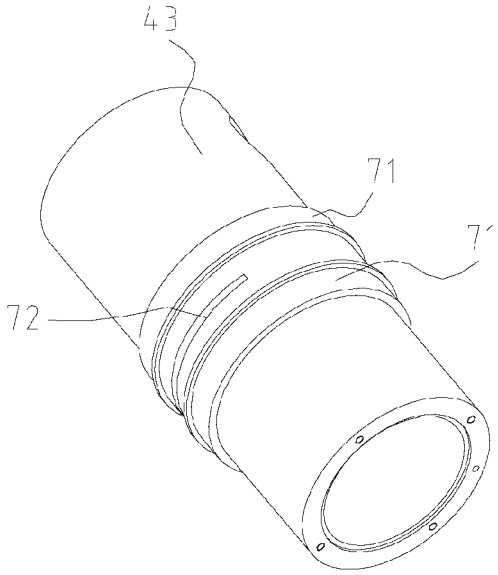
FIG. 7 is a three-dimension view of an outer sleeve with a ray outlet.

As shown in FIGS. 2, 5 and 6, the anode target 56 of the bulb tube 53 gives a great amount of heat out while generating the ray. In order to expedite heat dispersion, a number of fluid guiding holes 52 are distributed on the anode target 56 along the circumference thereof. When a cooling liquid passes through the fluid guiding holes 57, the heat from the anode target 56 is brought away, so that the normal operation of the bulb tube 53 is ensured.

Figure 9:
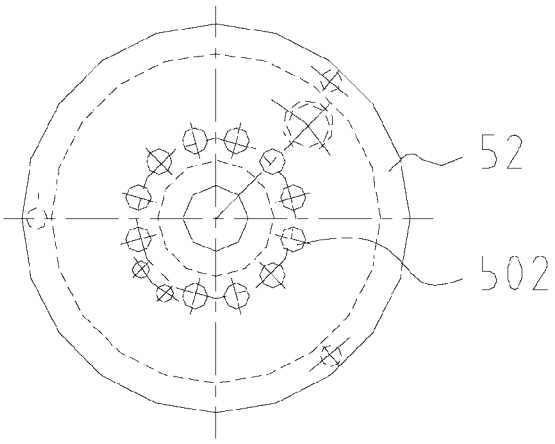
FIG. 9 is a top view in which the first anode insulation protecting seat and the second anode insulation protecting seat are assembled.

Furthermore, as shown FIGS. 2, 8 and 9, the cavity around the X-ray tube 53 is filled with the high voltage insulation oil, and the expansion drum 55 is further provided between the labyrinth protecting ring 54 and the cathode protecting end cap 41. The cavity around the bulb tube 53 is filled with the high voltage insulation oil to bring the heat generated from the bulb tube away. Since the insulation oil is heated, the volume of the insulation oil expands to press the expansion drum 55. At the same time, the heated insulation oil is drawn out from the tube joint 49 of the anode end cap 47 by a magnetic pump 23, and then is cooled by a heat exchanger 21, and then passes through a tube joint 48 provided at an end close to the labyrinth protecting ring 54, and then passes through the labyrinth channel formed by integrally combining the first anode insulation protecting seat 52 and the second anode insulation protecting seat 50, and then returns back into the cavity around the bulb tube 53 through the fluid guiding hole 57, so that the expansion amount of volume of the oil will be constant.

Figure 3:
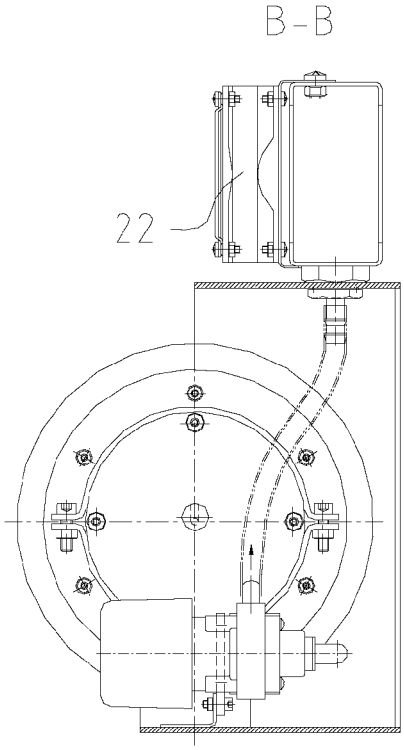
FIG. 3 is a sectional view taken along the B-B line of FIG. 1.
Figure 4:
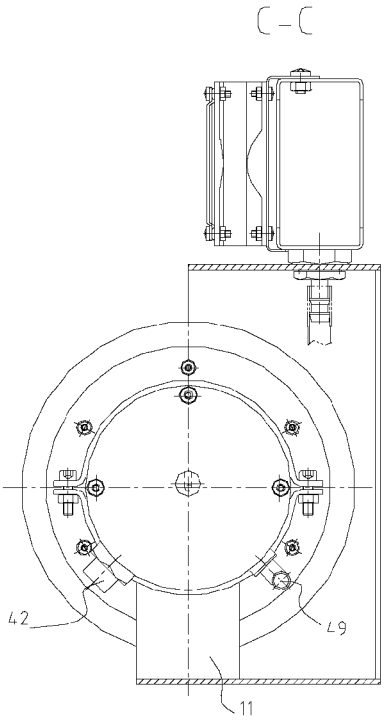
FIG. 4 is a sectional view taken along the C-C line of FIG. 1.

As shown in FIGS. 1-4, the cooling device 20 comprises the magnetic pump 23 configured to pump the heated high voltage insulation oil, the heat exchanger 21 configured to cool the pumped high voltage insulation oil, and an oil passage configured to convey the pumped high voltage insulation oil into the heat exchanger 21 for heat exchanging. Then, the cooled high voltage insulation oil returns back into the cavity around the X-ray tube 53. In a preferred embodiment, as shown in FIG. 3, the cooling device 20 further comprises a fan 22 for further enhancing the heat exchanging efficiency of the heat exchanger 21.

Next, the operation of the integrated flying-spot X-ray apparatus according to the specific embodiments of the present disclosure is explained in combination with FIGS. 2 and 10.

As shown in FIGS. 2 and 10, the revolving collimator device 60 with at least one aperture comprises the side protecting plates 61, the left end cap 62, the bearing 63, the flying-spot revolving protecting ring 64 and the right end cap 65. The bearing 63 is mounted on the boss 71 provided with the shaft shoulder and provided on the outer side wall of the outer sleeve 43, and the flying-spot revolving protecting ring 62 is mounted on the bearing 63 to form a rotation body. The flying-spot revolving protecting ring 65 are provided with a small through hole 75. The right end cap 65 is connected with a rotor 81 of the frameless torque motor 80 by screws, and a stator 82 is fixed on the supporting frame 10 by screws. The frameless torque motor 80 drives the revolving collimator device 60 with the through hole 75 to rotate. A dynamic spot-by-spot scanning operation can be achieved by revolving about the through hole 75 of the revolving collimator device 60 provided on the periphery of the ray generator 40. As shown FIG. 2, the side protecting plates 61 provided at two sides and the flying-spot revolving protecting ring 64 are made of a material which can shield the ray, and hence form a shielding cavity to efficiently prevent leakage of the ray.

Although the flying-spot revolving protecting ring 64 is provided with a small through hole along the radial direction in the above embodiment, the present disclosure is not limited thereto. A plurality of through holes may be provided.

While the present disclosure has been described in conjunction with the drawings, the embodiment shown in the drawings is only an example for explaining preferred embodiments of the present disclosure and is not intended to limit the present disclosure. Although some embodiments for the general concept of the present disclosure have been shown and explained, the skilled person in the art will appreciate that modifications to the above embodiments can be carried out without departing from the spirit and principle of the present general inventive concept. The scope of the present disclosure should be defined by the appended claims and equivalents thereof.

What is claimed is:

1. An integrated flying-spot X-ray apparatus, comprising:
- a ray generator configured to generate an X-ray;
- a revolving collimator device provided thereon with at least one aperture and arranged to be rotatable about the ray generator;
- a frameless torque motor configured to drive the revolving collimator device to rotate about the ray generator; and
- a cooling device configured to cool the ray generator,
- wherein the ray generator, the revolving collimator device, the frameless torque motor and the cooling device are mounted on an integrated mounting frame,
- wherein the ray generator comprises:
  - an x-ray tube;
  - a high voltage generator configured to drive the X-ray tube;
  - an inner protecting sleeve provided outside of the X-ray tube; and
  - an outer sleeve provided outside of the inner protecting sleeve;
  - wherein the inner protecting sleeve and the outer sleeve each have a ray outlet, and the ray outlets are aligned with each other and communicate with each other to direct the X-ray from the X-ray tube out of the ray generator,
- wherein an anode end cap is provided at a side of an anode target of the X-ray tube, and between the anode end cap and the anode target is further provided a first anode insulation protecting seat and a second anode insulation protecting seat which are combined to form a labyrinth channel, and
- wherein a cathode protecting end cap is provided at a side of a cathode of the X-ray tube, and between the cathode protecting end cap and the cathode of the X-ray tube is further provided a labyrinth protecting ring.

2. The integrated flying-spot X-ray apparatus according to claim 1, wherein the integrated mounting frame comprises:
- a supporting frame configured to support the frameless torque motor and the cooling device; and
- a bracket configured to be fixedly connected with the supporting frame to fix the ray generator.

3. The integrated flying-spot X-ray apparatus according to claim 1, wherein:
- the respective ray outlets of the inner protecting sleeve and the outer sleeve are provided therein with a calking window, and the calking window is made of a material through which the X-ray can pass.

4. The integrated flying-spot X-ray apparatus according to claim 3, wherein:
- a cavity around the X-ray tube is filled with a high voltage insulation oil; and
- between the labyrinth protecting ring and the cathode protecting end cap is further provided an expansion drum.

5. The integrated flying-spot X-ray apparatus according to claim 3, wherein the cathode protecting end cap, the inner protecting sleeve, the second anode insulation protecting seat, the first anode insulation protecting seat and the labyrinth protecting ring are made of a material that shields the ray, and the second anode insulation protecting seat and the first anode insulation protecting seat have an insulation property.

6. The integrated flying-spot X-ray apparatus according to claim 4, wherein the cathode protecting end cap is provided with a bending through hole, and the cathode protecting end cap and the expansion drum are fitted together to form a gas chamber.

7. The integrated flying-spot X-ray apparatus according to claim 3, wherein the outer sleeve is provided with a beam exiting opening opened at a certain angle, and the outer sleeve is further formed on an outer side wall thereof with a boss having a shaft shoulder.

8. The integrated flying-spot X-ray apparatus according to claim 1, wherein the first anode insulation protecting seat and the second anode insulation protecting seat are combined integrally to form a cavity, and a fluid guiding hole on the first anode insulation protecting seat and a liquid injecting hole on the second anode insulation protecting seat are misaligned with each other, so that a labyrinth structure is formed.

9. The integrated flying-spot X-ray apparatus according to claim 7, wherein the revolving collimator device comprises:

at least one bearing supported on the boss having the shaft shoulder of the outer sleeve;

a flying-spot revolving protecting ring supported by the at least one bearing and configured to be revolvable about the outer sleeve; and side protecting plates provided at two sides of the flying-spot revolving protecting ring, respectively, and right and left end caps.

10. The integrated flying-spot X-ray apparatus according to claim 4, wherein the cooling device comprises:

a magnetic pump configured to pump the heated high voltage insulation oil;

a heat exchanger configured to cool the pumped high voltage insulation oil; and an oil passage configured to convey the pumped high voltage insulation oil into the heat exchanger for heat exchanging, and the cooled high voltage insulation oil returns back into the cavity around the X-ray tube.

11. The integrated flying-spot X-ray apparatus according to claim 4, wherein the outer sleeve is provided with a beam exiting opening opened at a certain angle, and the outer sleeve is further formed on the outer side wall thereof with a boss having a shaft shoulder.

12. The integrated flying-spot X-ray apparatus according to claim 5, wherein the outer sleeve is provided with a beam exiting opening opened at a certain angle, and the outer sleeve is further formed on the outer side wall thereof with a boss having a shaft shoulder.

* * * * *